US008752737B2

(12) United States Patent
Ghavami-Nasr et al.

(10) Patent No.: US 8,752,737 B2
(45) Date of Patent: Jun. 17, 2014

(54) AEROSOL SPRAY DEVICE

(75) Inventors: Ghasem Ghavami-Nasr, Salford (GB); Andrew John Yule, Salford (GB); Martin Laurence Burby, Salford (GB)

(73) Assignee: The University of Salford, Greater Manchester (GB)

( * ) Notice: Subject to any disclaimer, the term of this patent is extended or adjusted under 35 U.S.C. 154(b) by 459 days.

(21) Appl. No.: 12/947,505

(22) Filed: Nov. 16, 2010

(65) Prior Publication Data

US 2011/0127300 A1 Jun. 2, 2011

Related U.S. Application Data

(60) Provisional application No. 61/261,912, filed on Nov. 17, 2009.

(51) Int. Cl.
*B65D 83/00* (2006.01)
*F16L 29/00* (2006.01)

(52) U.S. Cl.
USPC ..... 222/402.18; 222/402.1; 251/149.8

(58) Field of Classification Search
USPC ..... 222/402.18, 394, 402.1, 402.12, 222/402.25; 251/149.8; 137/247.21, 247.23
See application file for complete search history.

(56) References Cited

U.S. PATENT DOCUMENTS

| | | | | | |
|---|---|---|---|---|---|
| 2,919,101 | A | * | 12/1959 | Black | 251/25 |
| 3,542,254 | A | * | 11/1970 | Davenport et al. | 222/402.19 |
| 4,273,310 | A | * | 6/1981 | Ginzler | 251/211 |
| 4,608,211 | A | * | 8/1986 | Handjani et al. | 264/4.6 |
| 4,924,923 | A | | 5/1990 | Boehmer et al. | |
| 5,417,357 | A | * | 5/1995 | Yquel | 222/402.24 |
| 5,695,096 | A | * | 12/1997 | Yquel | 222/402.18 |
| 5,950,985 | A | * | 9/1999 | Petterson | 251/149.1 |
| 5,971,002 | A | * | 10/1999 | Turpin et al. | 137/43 |
| 6,047,946 | A | * | 4/2000 | Kolanus | 251/89 |
| 6,149,125 | A | * | 11/2000 | Nilsson | 251/82 |
| 7,204,393 | B2 | * | 4/2007 | Strand | 222/402.13 |

FOREIGN PATENT DOCUMENTS

| | | | |
|---|---|---|---|
| CH | 537 873 | | 6/1973 |
| EP | 0 635 310 | A1 | 1/1995 |
| EP | 0635310 | A1 * | 1/1995 |
| EP | 1 688 186 | A2 | 8/2006 |
| FR | 2 371 238 | A1 | 6/1978 |
| JP | 6092381 | A | 4/1994 |
| JP | 2003-230853 | A | 8/2003 |
| WO | WO-90/05580 | A1 | 5/1990 |
| WO | WO-2005/054584 | A1 | 6/2005 |

OTHER PUBLICATIONS

EP 0635310 A1—English Translation.*

* cited by examiner

*Primary Examiner* — Paul R Durand
*Assistant Examiner* — Benjamin R Shaw
(74) *Attorney, Agent, or Firm* — Tarolli, Sundheim, Covell & Tummino LLP

(57) ABSTRACT

The present invention provides a valving arrangement device for an aerosol spray device comprising a pressurized or pressurizable container which, when in its fully open configuration, has a loss coefficient of 10 or less. There is also provided a valving arrangement device for an aerosol spray device wherein, when in its fully open configuration, said valving arrangement is such that fluid passes from the upstream fluid flow path section into the downstream fluid flow path section with any change of the cross-sectional area of the fluid being less than 50% and with any change in direction of the flow being less than 40°.

35 Claims, 13 Drawing Sheets

AEROSOL SPRAY DEVICE

RELATED APPLICATION

This application claims priority from U.S. Provisional Patent Application No. 61/261,912, filed Nov. 17, 2009, the subject matter of which is incorporated herein by reference in its entirety.

FIELD OF INVENTION

The present invention relates to an aerosol spray device for discharging a liquid product (e.g. a household product such as an air freshener) in the form of a spray.

BACKGROUND TO INVENTION

Broadly speaking, aerosol spray devices comprise a container holding a liquid to be discharged together and an outlet nozzle associated with a valving arrangement which is selectively operable to allow discharge of the liquid as a spray from the nozzle by means of the propellant provided within the container.

Both "compressed gas propellant aerosols" and "liquefied gas propellant aerosols" are known. The former incorporate a propellant which is a gas at 25° C. and a pressure of at least 50 bar (e.g. nitrogen, carbon dioxide or air). On opening of the valving arrangement, the compressed gas "pushes" liquid in the spray device through the aforementioned nozzle that provides for atomisation. There are, in fact, two types of "compressed gas propellant aerosols". In one type, only liquid from the container ("pushed-out" by the compressed gas) is supplied to the outlet nozzle. In the other principal type, a portion of the propellant gas from the container is bled into the liquid being supplied to the nozzle which atomises the resulting two-phase, bubble-laden ("bubbly") flow to produce the spray. This latter format can produce finer sprays than the former.

In contrast, "liquefied gas propellant aerosols" use a propellant present as both a gas phase and a liquefied phase which is miscible within the liquid in the container. The propellant may, for example, be butane, propane or a mixture thereof. On discharge, the gas phase propellant "propels" the liquid in container (including dissolved, liquid phase propellant through the nozzle).

It is well known that "liquefied gas propellant aerosols" are capable of producing finer sprays than "compressed gas propellant aerosols". This is due to the fact that, in the former, a large proportion of the liquefied gas "flash vaporises" during discharge of liquid from the aerosol spray device and this rapid expansion gives rise to a fine spray. Such fine sprays cannot generally be achieved with "compressed gas propellant aerosols", in either of the two principal formats described above.

In spite of the fact that conventional "liquefied gas propellant aerosols" are able to produce finer sprays than their "compressed gas" counterparts, we consider there to be a general need for improving the spray discharge characteristics (particularly with regard to "fineness" of spray) of aerosol spray devices, whether they be of the "compressed gas propellant" or "liquefied gas propellant" type. The present invention seeks to address this need.

SUMMARY OF INVENTION

According to a first aspect of the present invention there is provided a valving arrangement device for an aerosol spray device comprising a pressurised or pressurisable container, said valving arrangement provided between an upstream and downstream fluid flow path sections co-operable to provide a fluid flow path between liquid in the container and a nozzle, and an actuator mechanism for selectively fully opening and closing the valving mechanism wherein in its fully open configuration said valving arrangement has a loss coefficient of 10 or less when fully open.

Preferably, the loss coefficient is measured when tested with distilled water at 20° C. (see appendix 1).

The valving arrangement according to the first aspect of the invention may be used in an aerosol spray device comprising a pressurised container holding a liquid to be discharged by a propellant.

The loss coefficient of a valving arrangement may be determined by the procedure detailed in Appendix 1 to this specification.

Preferably the loss coefficient of the valving arrangement (when fully open) employed in the aerosol spray device of the invention is 5 or less, or even 2 or less.

The use of the valving arrangement having a loss coefficient of 10 or less (preferably 5 or less) when the valving arrangement is fully open has the advantage that there are negligible energy losses when fluid passes through the valving arrangement from the interior of the container to the nozzle. (For this reason, and for convenience, such valving arrangements are also referred to herein as "low-loss valves"). Consequently the pressure at the entrance to the nozzle is much closer to the pressure within the container than in the case of valves normally employed in aerosols for which a significant pressure drop occurs through the valve. Such a pressure drop, as caused by the conventional valves, has a complex effect on the flow-rate (through the nozzle) and drop size of the spray. The use of a low-loss valve permits all pressure drops, to be controlled only by the design of the insert and actuator. This gives the opportunity of much improved control of atomising efficiency and flow rate. The invention is applicable particularly, but not exclusively, to "compressed gas propellant aerosols", i.e. aerosol spray devices in which the propellant is a compressed gas which has the property of being a gas at 25° C. and a pressure of at least 50 bar. The invention is most particularly applicable to such aerosols in which some of the propellant gas is bled (or otherwise introduced) into the liquid flow at a location upstream of the valve (to create a bubble-laden ("bubbly") flow). For such cases (where some gas is mixed with the liquid before the valve), there is both the benefit of maximising the available pressure at the nozzle, and also avoiding interfering with the structure of the bubbly flow in a manner that reduces atomisation quality, for example by causing coalescence of bubbles or stratification of the liquid and gas phases of the fluid flow.

The invention is however also applicable to "compressed gas propellant aerosols" in which only liquid in the container ("pushed-out" by the propellant gas) is passed along the fluid flow path to the nozzle (i.e. without bleed of propellant gas into the liquid flow) with the attendant advantage that the pressure at the inlet to the nozzle is closer to the pressure in the container than in prior art constructions.

In the case of "compressed gas propellant aerosols", the propellant may, for example, be nitrogen, carbon dioxide or air.

Additionally the invention may with advantage be applied to "liquefied gas propellant aerosols", i.e. aerosol spray devices that use a propellant present as both a gas phase and a liquid phase which is miscible with the liquid in the container. In such a case, the use of the low-loss valve not only maximises the pressure at the nozzle but also gives potential to reduce the required amount of liquefied gas propellant in the container. In the case of "liquefied gas propellant aerosols", the propellant may be a hydrocarbon, for example, butane, propane and mixtures thereof.

Low-loss valves employed in the invention will generally be such that, when in their fully open configuration, fluid passes from the upstream fluid flow path section into the downstream fluid flow path section with any change of the cross-sectional area of the fluid being less than 50% and with any change in direction of the flow being less than 40°. This leads to a further, second aspect of the invention according to which there is provided a valving arrangement device for an aerosol spray device comprising a pressurised or pressurisable container, said valving arrangement provided between an upstream and downstream fluid flow path sections cooperable to provide a fluid flow path between liquid in the container and a nozzle, an actuator mechanism for selectively fully opening and closing the valving mechanism, wherein in its fully open configuration said valving arrangement is such that fluid passes from the upstream fluid flow path section into the downstream fluid flow path section with any change of the cross-sectional area of the fluid being less than 50% and with any change in direction of the flow being less than 40°.

The valving arrangement according to the second aspect of the invention may be used in an aerosol spray device comprising a pressurised container holding a liquid to be discharged by a propellant.

Both first and second aspects of the invention may be combined, i.e., they are not mutually exclusive.

In preferred embodiments of the first and second aspects of the invention, any change of the cross-sectional area of the fluid is less than 25%, more preferably less than 10%. Most preferably there is no change in cross-sectional area of the fluid as it passes through the valving arrangement. Additionally, there is preferably no change in the actual cross-sectional (i.e. the "cross-sectional shape") of the fluid as it passes through the valving arrangement.

Preferably also any change in direction of the flow as it passes through the valving arrangement is preferably less than 20°, more preferably less than 10°. Ideally there is no change in direction of the fluid flow as it passes through the valving arrangement.

In preferred embodiments of aerosol spray devices in accordance with either the first or second aspects of the invention the upstream and downstream fluid flow path sections are of substantially identical cross-section, preferably identical cross-section.

One example of valving arrangement suitable for use in the invention has a valve member with a bore of constant cross-section which is moveable between a first position in which the valving arrangement is closed and a second position in which the bore aligns with said upstream and downstream fluid flow path section to provide for fully opening of the valving arrangement. In such embodiments, the aerosol spray device may comprise a fixed valve stem (in which the valve member is incorporated) and the valve member is moved between its closed and open positions by a mechanism (e.g. a linkage) operated by the actuator. The valve member may be rotable between said first and second positions. Examples of valving arrangement of this type include ball valves and also cylinder valves in which the bore is transverse to the axis of rotation. A further example is a valving arrangement in which the valve member is cylindrical and the bore is axially parallel to, and offset from, the axis or rotation with which it is also parallel.

In a further embodiment of aerosol spray device in accordance with either the first or second aspect of the invention, the upstream and downstream fluid flow path sections are movable relatively towards each other with operation of the actuator mechanism to open the valving arrangement and where said valving arrangement is opened by said relative movement to allow said upstream and downstream flow path sections to come into register with each other. As used herein, "movable relatively towards each other" means that either the upstream or downstream fluid flow path is moveable, or both are moveable. Preferably, to open the valve, the downstream flow path is moved towards the upstream flow path.

In this embodiment, the valving arrangement may, for example, incorporate a ball. In the closed valve position, the ball closes the flow path, thus preventing the release of fluid pressure. Preferably, the ball removeably locates in a lower end of the downstream flow path section. When the actuator mechanism is operated to open the valving mechanism, the ball is displaced from the lower end of the downstream flow path section which then comes into register with the upstream flow path section. Preferably, when the valving is open, the ball is biased towards the closed position. Thus, when the upstream and downstream fluid flow path sections move relatively away from one another, the ball is biased such that is comes into registration with the lower end of the downstream flow path section, thus closing the valve. In this embodiment, the biasing of the ball may be effected by any suitable means. For example, the biasing is effected by a spring, a resilient material, a slope, a wedge or the like. Preferably, the displacement of the ball from the lower end of the downstream flow path section causes the ball to come into contact with the biasing means. Alternatively, the biasing means may be in constant contact with the ball throughout the operation of the valve, i.e., from closed to open and back to closed.

The same effect can be achieved by, for example, making the ball positively buoyant relative to the fluid in the pressurised container. This allows the ball to 'float' in the liquid, thereby returning to the closed position when the upstream and downstream fluid flow path sections move relatively away from one another.

The ball may also be returned to the closed position simply by the effect of fluid pressure. For example, as the upstream and downstream fluid flow path sections move relatively away from one another, the fluid pressure may be diverted to cause the ball to move into the closed position.

Preferably, the diameter of the ball is greater than that of the bore of the downstream flow path.

In the closed valve position, preferably the ball resides on a seat. The seat preferably creates a seal with the ball. Preferably, the seat is recessed within a chamber of the valve stem.

When the valve is opened, preferably, the ball is displaced laterally of the upstream and downstream fluid flow path. Preferably, the ball is retained in a chamber which is configured to facilitate this lateral displacement. For example, as said upstream and downstream flow path sections to come towards one another, the ball is moved by the downstream flow path against displacement means.

In a particularly preferred embodiment, the apparatus of the invention incorporates a ball (as described immediately above), which incorporates a biasing spring which is laterally offset relative to the direction of the fluid flow. Opening of the valve causes both the ball and the spring to be pushed laterally out of the fluid flow path.

In another embodiment, the valving arrangement may, for example, incorporate a duckbill valve. Such a valve comprises two converging flaps of elastomeric materials which are biased together so as to maintain the valve closed. In the aerosol spray device, the duckbill valve is oriented so that these flaps converge towards the interior of the container and are held closed by the pressure therein. In order to open the duckbill valve (to effect discharge of fluid(s)) a tubular actuator (provided as part of the downstream fluid flow path section) through which fluid(s) may flow may be provided on an actuator cap of the spray device arranged such that, by depressing the cap, the lower end of the actuator engages against the interior surfaces of the converging flaps and causes them to open against the pressure of the gas within the container and allow the tubular actuator to come into register with the upstream flow path section whereby liquid may be discharged from the spray device.

In a further possibility for this embodiment, the valving arrangement may incorporate a flap having one end fixed in position and the other end in the form of a plug which removably locates in a lower end of the downstream flow path section, the device being such that on operation of the actuator mechanism to open the valving arrangement the plug is displaced from the lower end of the downstream flow path section which then comes into register with the upstream flow path section. The flap may, for example, be made of a resilient material.

A further example of valving arrangement that may be used in aerosol spray devices in accordance with the first or second aspect of the invention comprises a flexible walled tube connecting said upstream and downstream fluid flow path sections, tube closure means biased to a first position for pinching said tube to provide for the closed configuration of the valving arrangement, and tube opening means operable by the actuator to displace said tube closure means against the bias to provide for the open configuration of the valving arrangement.

The nozzle (referred to as an 'insert' in the technical field) in the aerosol spray device may for example be a "small swirl atomiser" and may be of the type known as a "mechanical break-up" (MBU) nozzle. Alternatively, the nozzle may be a simple orifice. In the case of compressed gas with gas bled into the liquid, the insert may be a special design incorporating features to maximise atomisation quality for the fluid flow. In all cases, the nozzle may be provided (as conventional in aerosol technology) as an insert in an actuator cap of the aerosol spray device.

The invention will now be further described by way of example only, with reference to the accompanying drawings, in which:

FIG. 1 schematically illustrates a first embodiment of aerosol spray device in accordance with the invention incorporating a duckbill valve as the low-loss valve;

FIG. 2 schematically illustrates a second embodiment of aerosol spray device in accordance with the invention, incorporating a ball valve as the low-loss valve;

FIG. 3 schematically illustrates a third embodiment of the invention incorporating a plug type of seal as the low-loss valve;

FIGS. 4*a* and 4*b* schematically illustrate a fourth embodiment of aerosol spray device in which the low-loss valve incorporates a flexibly walled tube, FIGS. 4*a* and 4*b* respectively showing the valve in the closed and open positions;

FIGS. 5*a* and 5*b* schematically illustrate a fifth embodiment of the invention in which the low-loss valve incorporates a cylindrical section with an off-centre orifice;

Figure 10A:
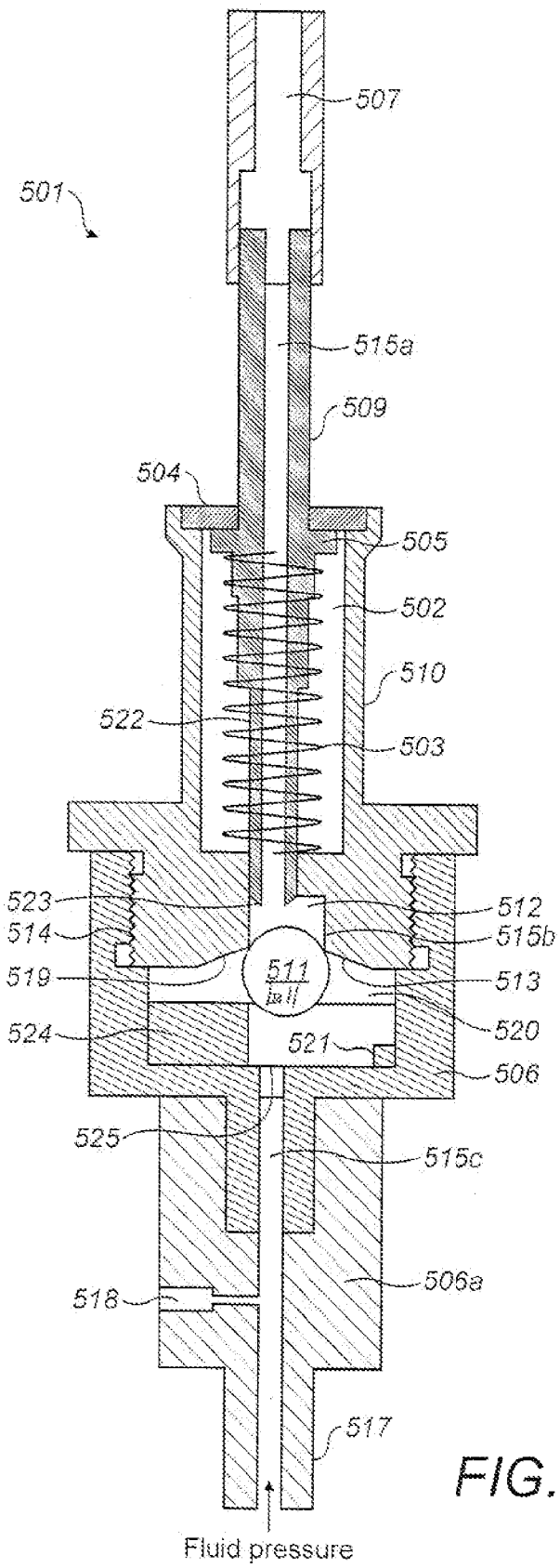
Figure 10B:
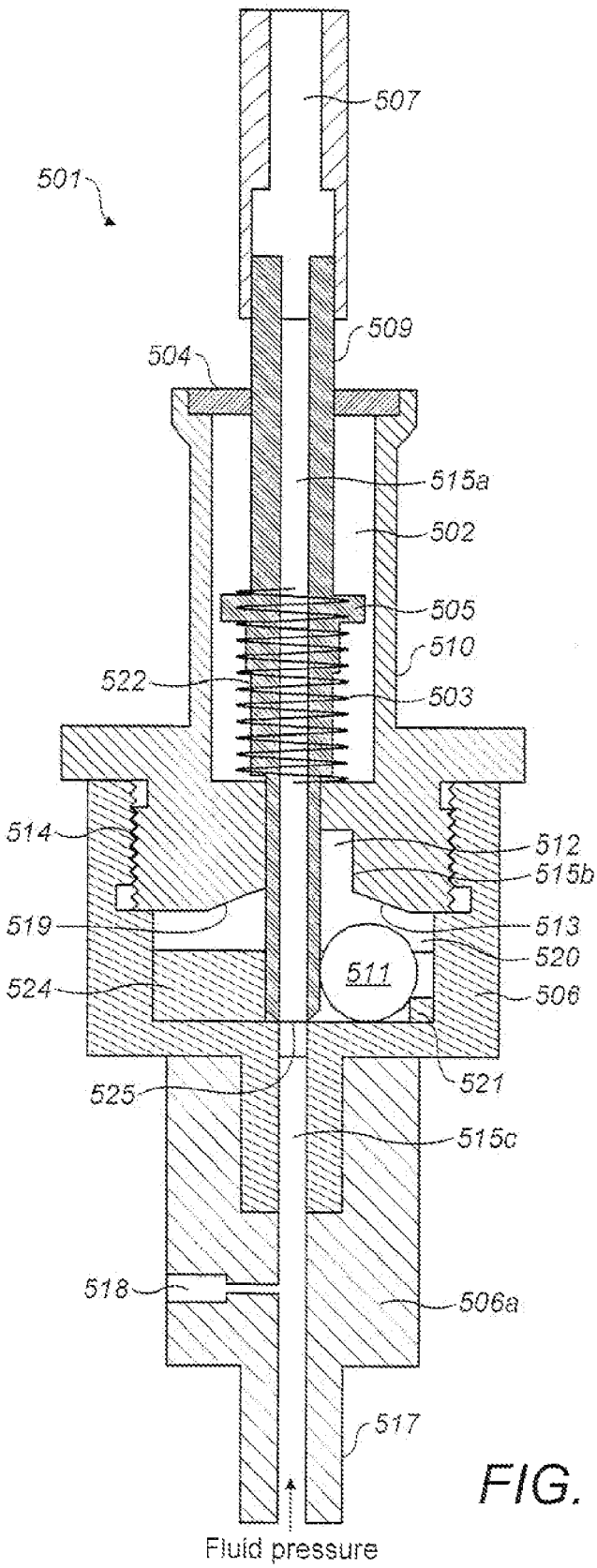
Figure 11A:
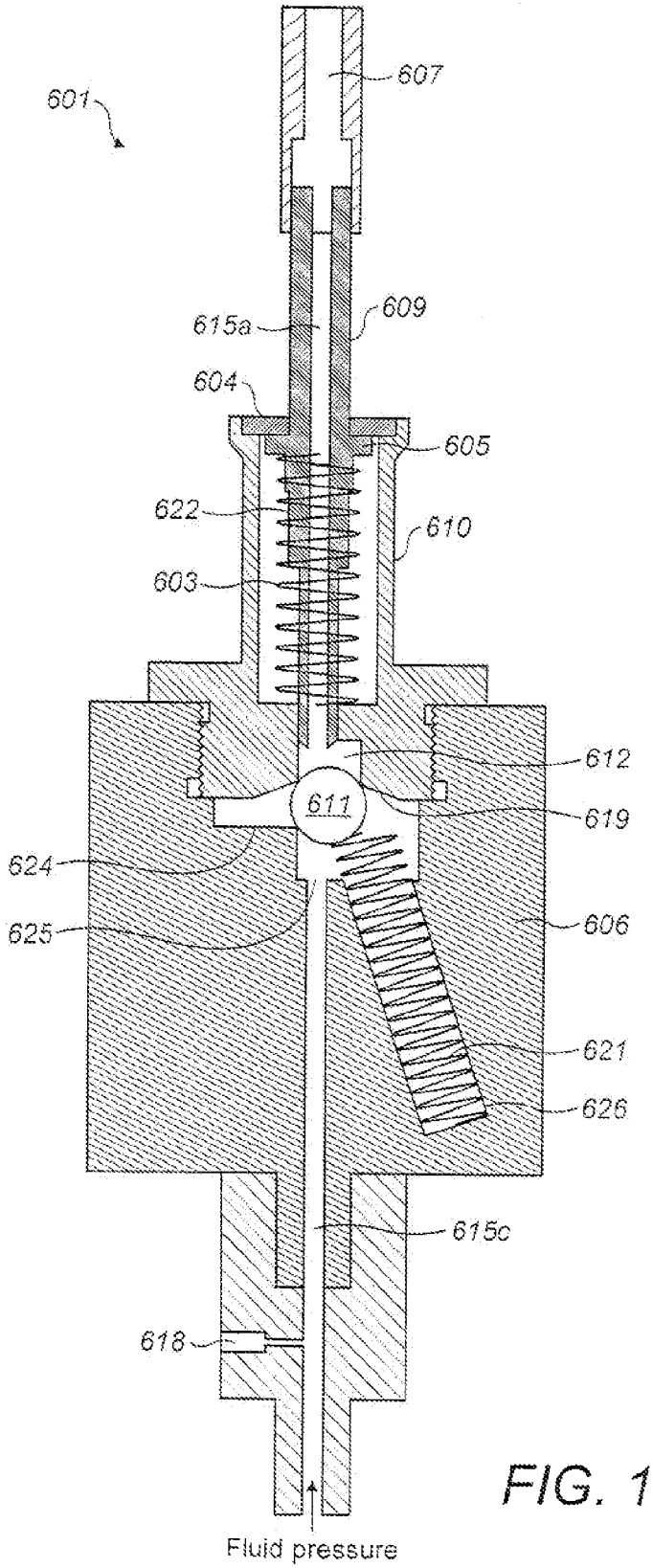
Figure 11B:
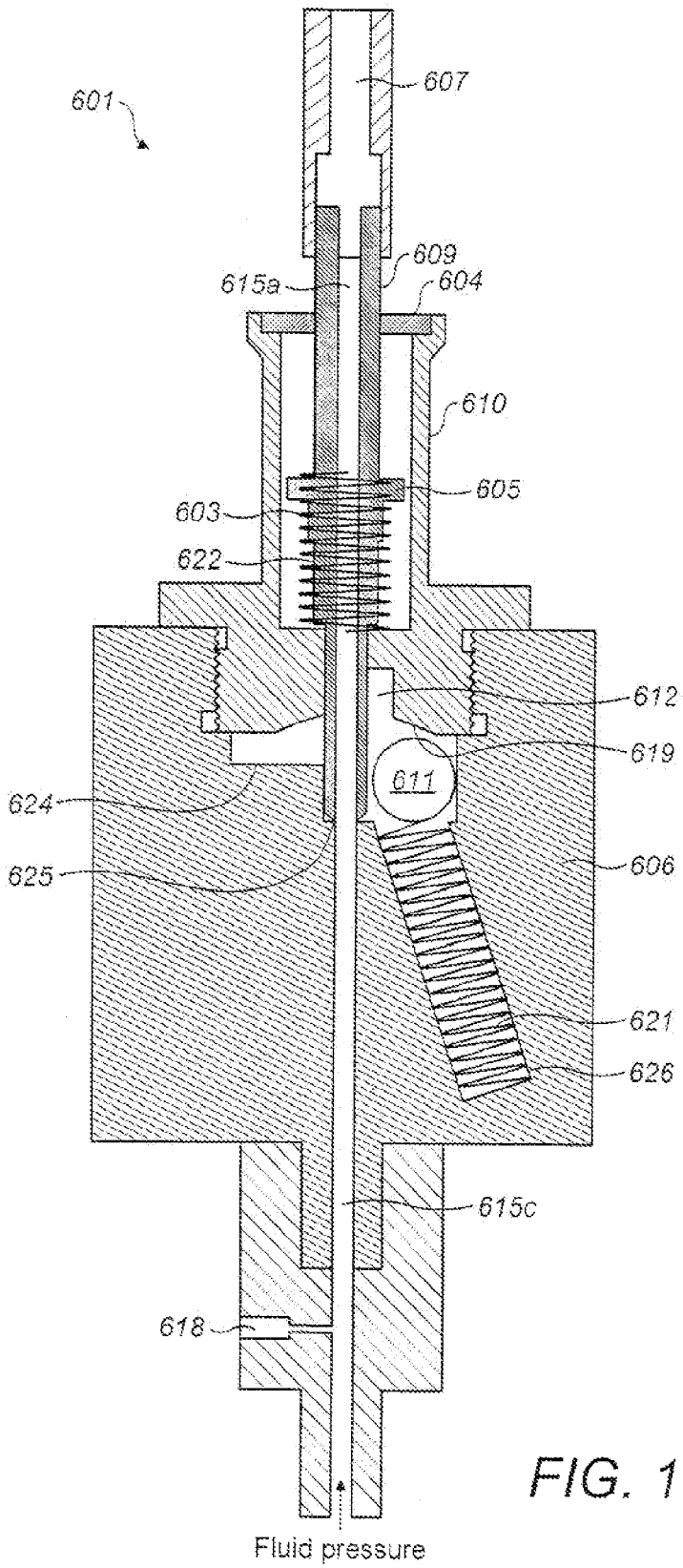

FIGS. 10*a* and 10*b* schematically illustrate a sixth embodiment of the invention in which the low-loss valve incorporates a ball in the valve assembly; and FIGS. 11*a* and 11*b* schematically illustrate a seventh embodiment of the invention in which the low-loss valve incorporates a ball in the valve assembly.

In the following description, references to "upper" and "lower" are to the devices as illustrated in the drawings which are represented in their normal operational positions. References in the description to the "rest" position of the device is when the apparatus is not emitting a spray.

Figure 1:
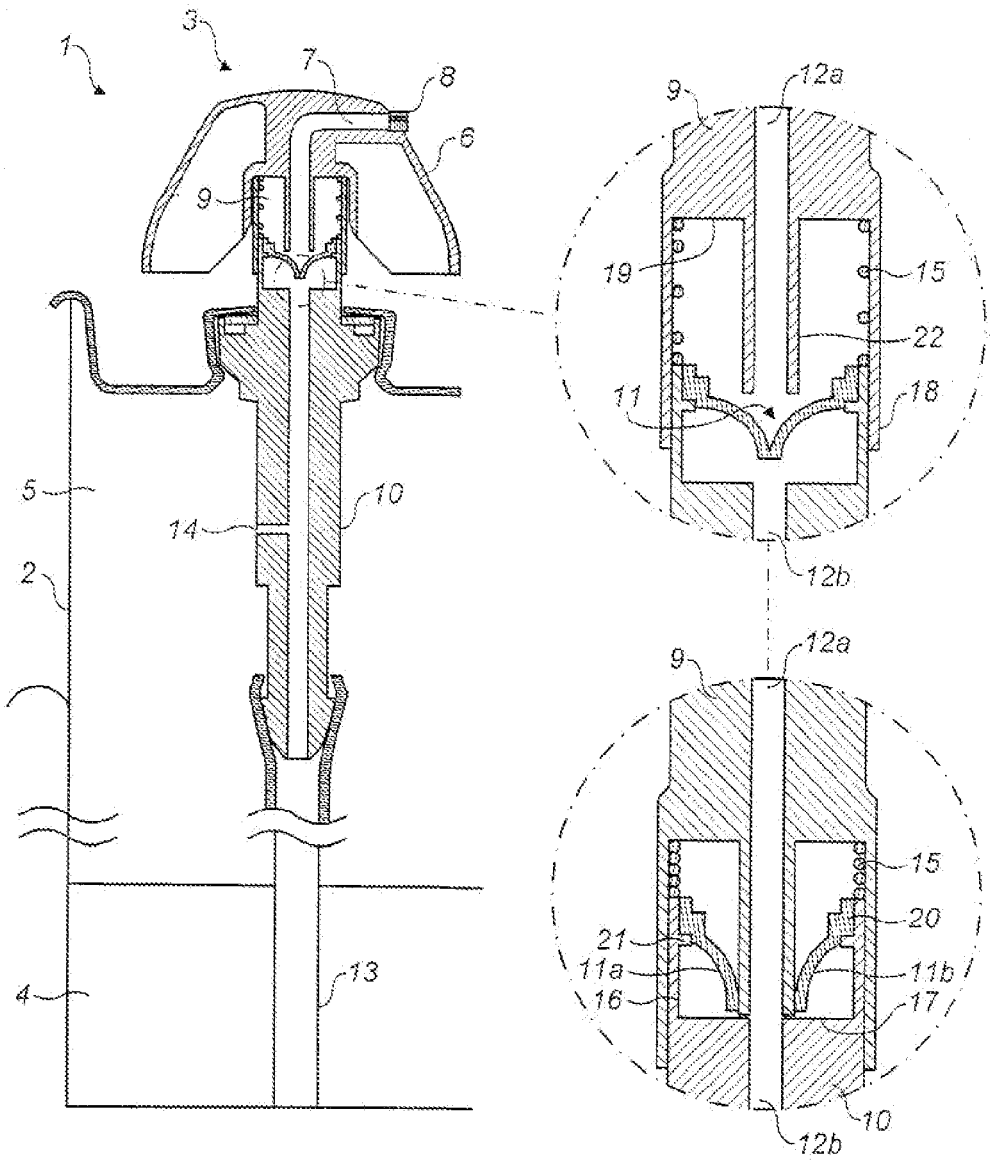

FIG. 1 illustrates a first embodiment of compressed gas propellant aerosol spray device 1 in accordance with the invention in the normal "rest" position. The spray device 1 comprises a pressurised container 2 on the top of which is mounted a spray discharge assembly 3 crimped on to the top portion of container 2. Provided within container 2 is a liquid 4 to be dispensed by a propellant which is present only as a gas (i.e. there is no liquefied propellant). The gaseous propellant is present in the head space 5 of the container and may, for example, be nitrogen, carbon dioxide or air.

Spray discharge assembly 3 comprises an actuator cap 6 incorporating a passageway 7 leading (at its downstream end) to a spray nozzle 8, valve stem parts 9 and 10 and a duckbill valve 11, all assembled together in the manner described more fully below. Conveniently, the actuator cap is a push fit on the upper end of valve stem part 9. Alternatively the cap 6 and upper valve stem part may be moulded as a one-piece component.

Duckbill valve 11 is of elastomeric material and comprises a pair of flaps 11*a* and 11*b* which open and close in the manner of the bill of a duck. More specifically, the flaps 11*a* and 11*b* resile towards the closed position of the valve at which the flaps converge together to effect closure. The duckbill valve functions as a one-way valve which normally remains closed until an appropriate force is applied to the interior faces of the closed flaps. A suitable duckbill valve is available from Minivalve International (see www.minivalve.com). As shown in the drawing, and described in more detailed below, the "duckbill" valve points downwardly and in the rest position of the spray device 1 is held closed by the pressure within container 2. However, operation of the actuator cap 6 effects opening of the duckbill valve 11 to cause a spray of the liquid 4 to be discharged through the nozzle 8.

The construction of spray discharge assembly 3 will now be described in more detail.

As mentioned, there are two valve stem parts 9 and 10. These are coaxial and have aligned bores 12*a* and 12*b* respectively of identical cross-section. Valve stem part 10 is the lower part (as seen in FIG. 1) and is fixed relative to the container 2. Liquid 4 is delivered to the bore of valve stem part 10 via a dip tube 13 affixed to the lower end of valve stem part 10. Additionally gas from headspace 5 can be bled into the bore 11 of valve stem part 10 via a passageway 14 located in the wall of lower valve stem part 10 above the level to which container 2 is initially filled. Whereas lower valve stem part 10 is fixed, the upper valve stem part 9, on which actuator cap 6 is mounted, is movable relative to the lower valve stem part 10 and is biased away therefrom by a coil spring 15. At its upper end, the bore 12*a* in upper valve stem part 9 is in communication with the passageway 7 in actuator cap 6.

As shown more clearly in the insets to FIG. 1, lower valve stem part 10 is extended by an upper flange 16 surrounding upper end face area 17 of valve stem part 10. Upper valve stem part 9 has a lower flange 18 which encircles lower end face 19 (of upper valve stem part 9).

Duckbill valve 11 has an upper ring 20 which seats on an internal annular ledge 21 provided on flange 16. Coil spring 15 locates between the upper end of flange 16 and the lower end face area 19 of upper valve stem part 9 so as to bias the latter upwardly away from the duckbill valve 11.

Depending from end face 17 of upper valve stem part 9 is a tubular spigot 22 of a length such that, in the "rest" position of the aerosol device 1, the lower end of spigot 22 locates above the flaps 11*a* and 11*b* of the duckbill valve 11. It should be noted that the internal cross-section of tubular spigot 22 is identical with that of the bores 12*a* and 12*b* in the upper and lower valve stem parts 9 and 10.

Thus in the "rest" condition of the aerosol spray device 1, duckbill valve 11 is maintained closed by the pressure within the container 2 to which it (the valve) is exposed via the bore 12*b* in lower valve stem part 10.

However by depressing actuator cap 6, upper valve stem part 9 is caused to move downwardly so that the lower end of tubular spigot 22 parts the flaps 11*a* and 11*b* of duckbill valve 11 so the latter opens to liquid flow. Thus liquid 4 in the container 2 may now pass upwardly along the dip tube 13, the aligned bores 12*a* and 12*b* of the valve stem parts 9 and 10 and through the passageway 7 (in actuator cap 6) to the nozzle insert 7 for discharge as a spray.

It will be appreciated from the lower inset to FIG. 1, that fluid passes from the bore 12*b* in lower valve stem 10 into the bore 12*a* in upper valve stem part 9 along a passageway (i.e. that within the tubular spigot 22) which provides no change in cross-sectional area as compared to the bores 12*a* and 12*b*. Thus the liquid 4 suffers substantially no pressure loss as it moves past the (now-open) duckbill valve 11 so that the pressure at the upstream end of the nozzle 8 is effectively the same as the pressure within the container 2. This provides for much improved atomising efficiency within the nozzle 8, as compared to the case of a conventional valve where this is a significant pressure drop across the valve.

Once the actuator cap 6 is released, it is moved upwardly by the bias of coil spring 15 so that tubular spigot 22 moves away from the flaps 11*a* and 11*b* of the duckbill valve 11 which therefore return to their closed position at which they are maintained by the pressure within the container 2.

Figure 2:
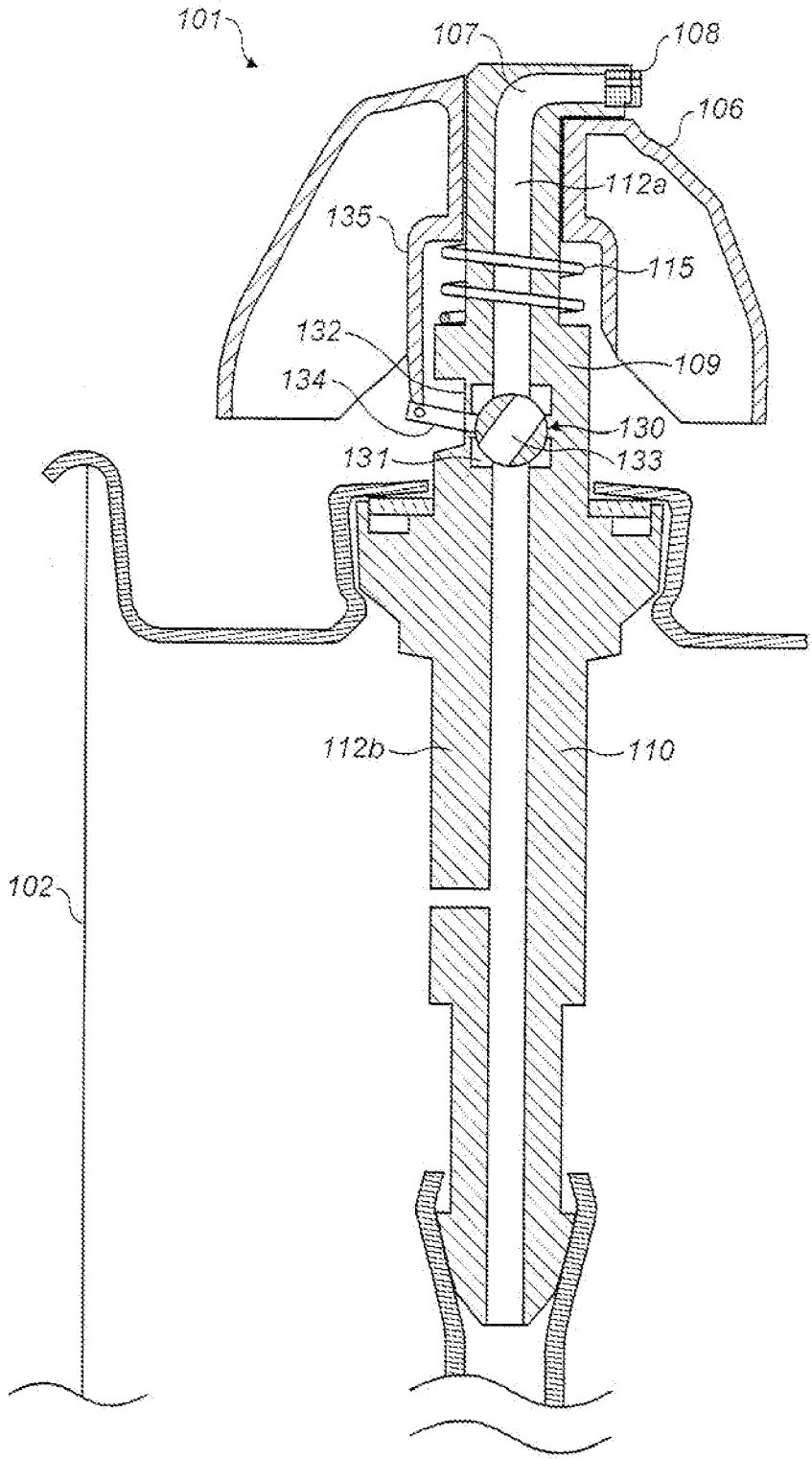

Reference is now made to FIG. 2 which shows a second embodiment of aerosol spray device 101 in accordance with the invention. For convenience, parts shown in FIG. 2 which have a corresponding part in FIG. 1 are given the same reference numeral plus 100. Thus, for example, the actuator cap 106 in FIG. 2 is equivalent of actuator cap 6 in FIG. 1.

The embodiment of FIG. 2 incorporates a ball valve assembly 130 in place of the duckbill valve 11 of FIG. 1. Ball valve assembly 130 is located between component parts 109 and 110 of the valve stem, although in contrast with the embodiment of FIG. 1 both of these component parts are fixed relative to the container 102. Actuator cap 106 is mounted on upper valve stem component 109 and biased away therefrom by a coil spring 115.

Ball valve assembly 130 comprises a ball 131 rotatably mounted in a seat 132 and having a central bore 133 which is of identical cross-section to the bores 112 in upper and lower valve stem parts 109 and 110. Ball 131 is associated with an actuating lever 134 pivotably connected at its free end to an operating arm 135 fixed on the valve cap 106. The arrangement is such that, in the "rest" position of the aerosol spray device 101, the ball 131 (of ball valve 130) is oriented such that the aligned bores 112*a* and 112*b* of valve stem parts 109 and 110 are isolated from each other. However depression of the actuator cap 106 against the biasing spring 115 causes the operating arm 135 to move lever 134 and rotate the ball 131 to a position at which its bore 133 provides communication between the aligned bores 111 of the valve stem parts.

Thus liquid from the container 102 is now able to pass to nozzle 108 for production of a spray.

As in the case of the duckbill valve 10 employed in the embodiment of FIG. 1, there is substantially no pressure drop across the ball valve 130, this being achieved by virtue of the fact that the bore 133 of the ball 131 is of identical cross-section to that of the bores 112*a* and 112*b* in the valve stem parts 109 and 110. Therefore the pressure at the upstream side of nozzle 107 effectively corresponds with the interior pressure of container 102.

Figure 3:
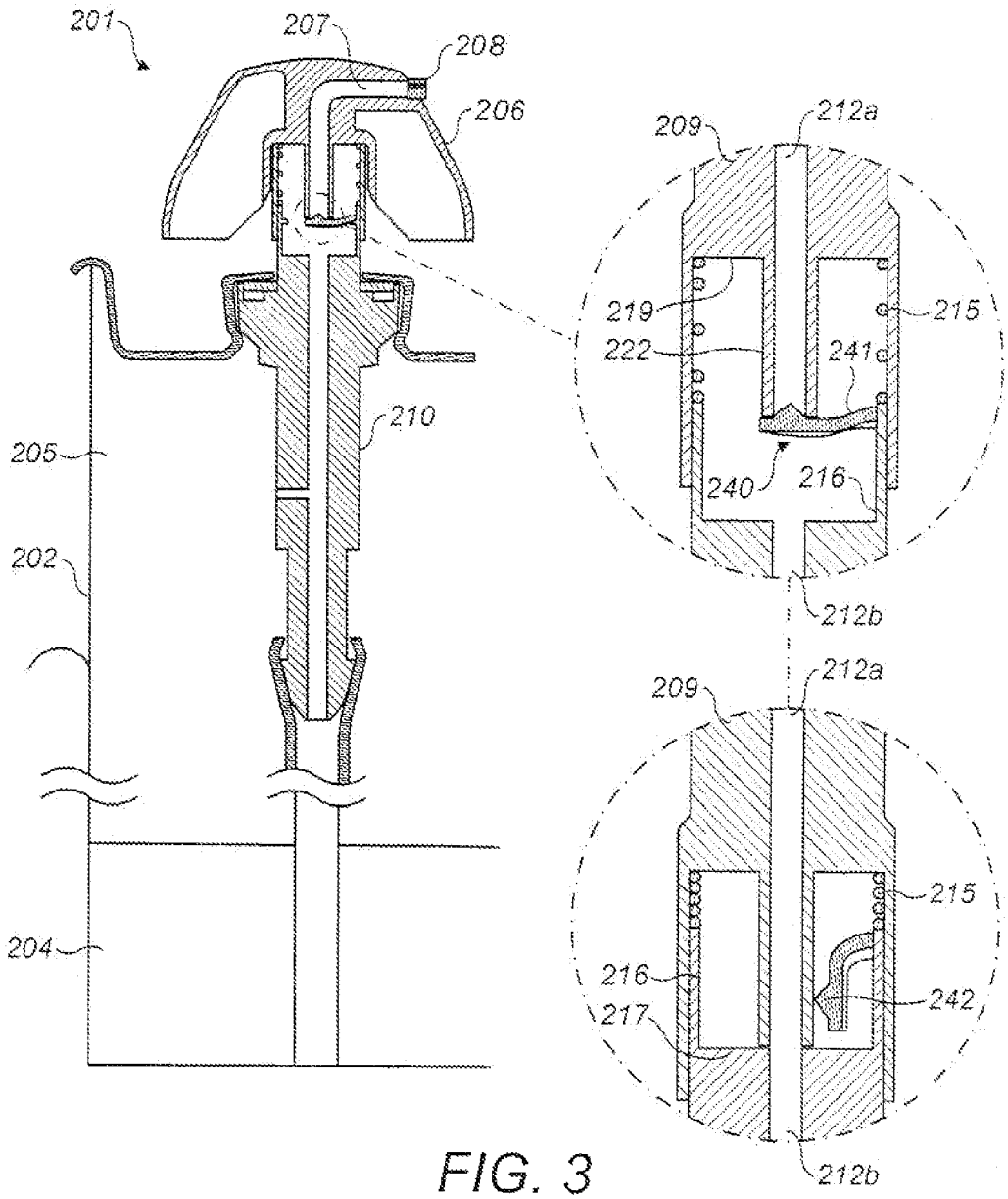

Reference is now made to FIG. 3 which shows a third embodiment of aerosol spray device 201 in accordance with the invention. For convenience, parts shown in FIG. 3 which have a corresponding part in FIG. 1 are given the same reference numeral plus 200.

In the embodiment of FIG. 3, the duckbill valve 11 employed in FIG. 1 is replaced by a simple plug type of seal 240 which is of a resilient material and which, at one end, comprises a flexible hinge portion 241 mounted at the upper end of the internal surface of flange 216 and at its other, free end a plug 242. In the rest condition of the aerosol spray device 201, the plug type seal 240 is generally horizontal and the plug 242 locates in the lower end of tubular spigot 222. Pressure from within the container 202 ensures that the plug 242 is urged (and seals) against the lower end of tubular spigot 222. When actuator cap 206 is depressed, tubular spigot 222 moves downwardly and deflects the hinge 241 so that (as shown in the lower inset to FIG. 3) the lower end of tubular spigot 222 comes into contact with the upper end face area 217 of lower valve stem part 210 and aligns with its bore 212. Thus fluid from within container 202 may now pass to nozzle 207 without significant pressure loss.

Figure 4A:
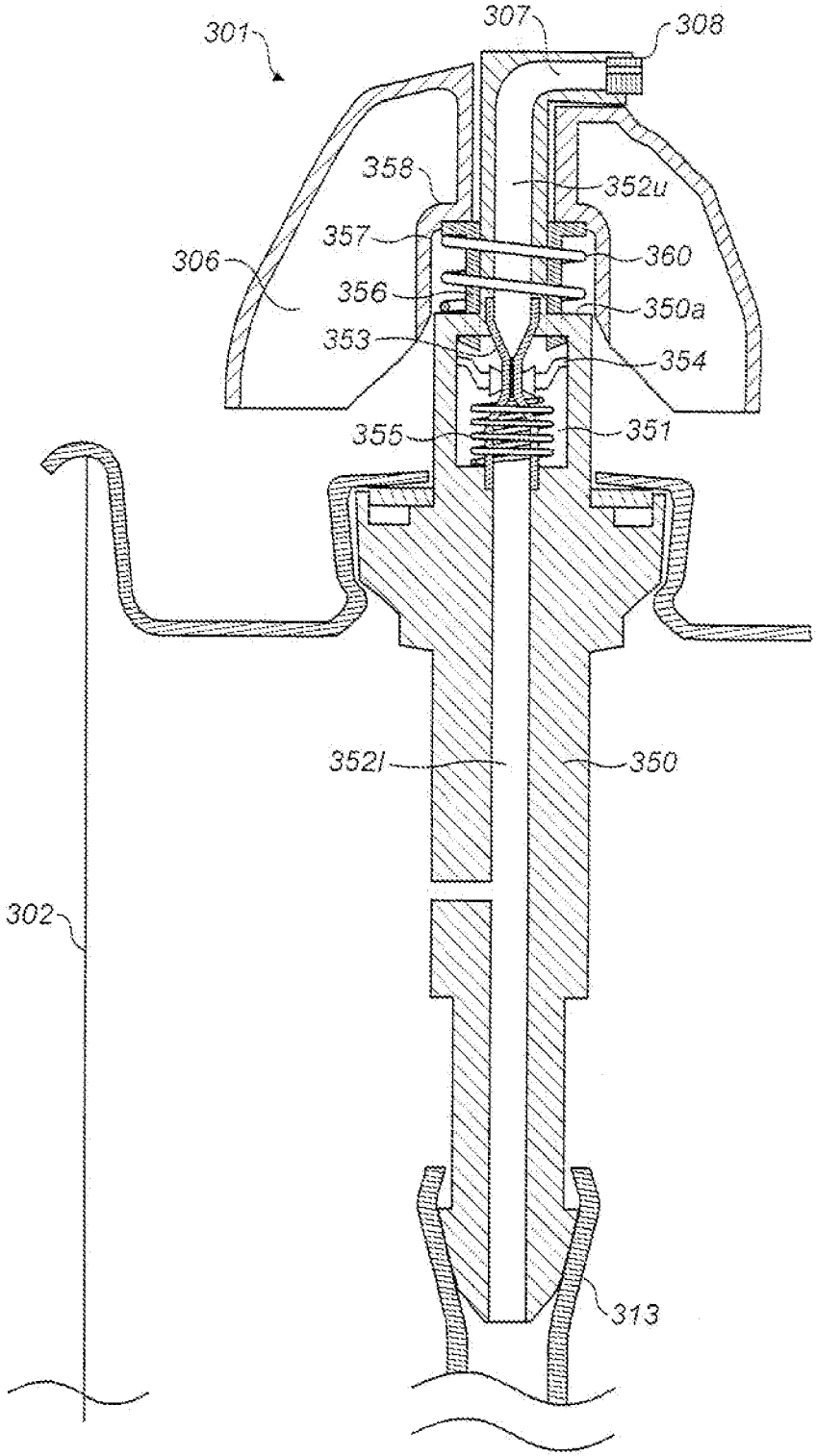
Figure 4B:
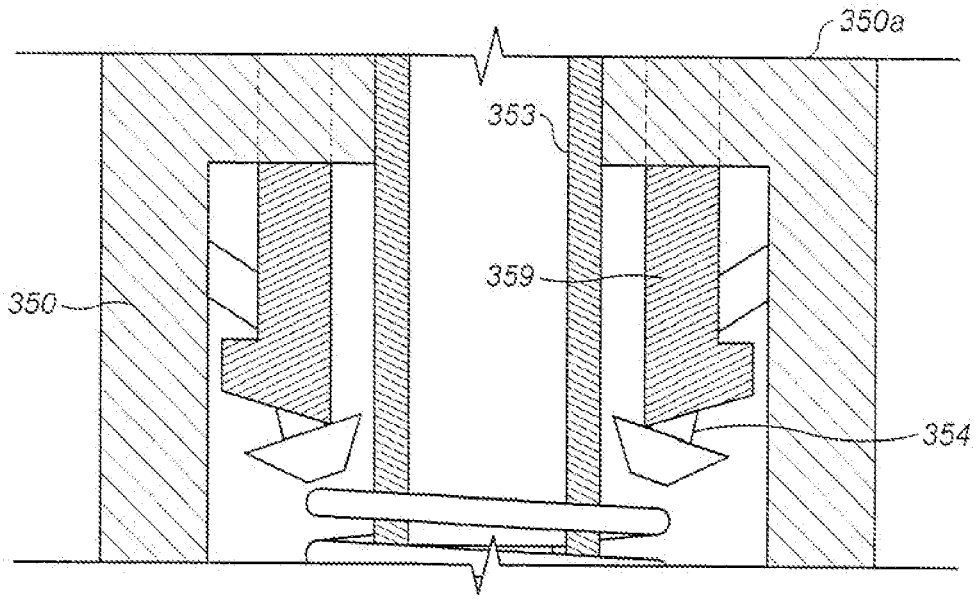

Reference is now made to FIG. 4 which shows a fourth embodiment of aerosol spray device 301 in accordance with the invention. For convenience, parts shown in FIG. 4 which have a corresponding part in FIG. 1 are given the same reference numeral plus 300.

In the embodiment of FIG. 4, there is a one-piece valve stem 350 which is fixed relative to the container 302. Valve stem 350 has a shoulder 350*a* whereby upper region of valve stem 350 is of lesser external diameter than the lower section. Lower end of valve stem 350 is attached to dip tube 313 whereas the upper end incorporates nozzle 308. Formed within the valve stem 350 is a chamber 351, above and below which the valve stem has bore sections 352*u* and 3521 respectively, these sections being connected by a flexible walled tube 353 which traverses chamber 351.

Within chamber 351 are a pair of arms 354 each attached to opposed portions of the wall of chamber 351. These arms may be of a resilient material or attached by means of hinges to the interior surface of chamber 351. Additionally provided within the chamber 351 is a coil spring 355 which (in the rest condition of the aerosol spray device 301) urges the arms 354 to a position at which they cooperate to "pinch" the tube 353 to the extent that fluid flow along the tube is prevented.

Further provided in the aerosol spray device 301 is a collar 356 which encircles an upper region of valve stem 350 and is slideable along this section. At its upper end, collar 356 is provided with an annular flange 357 which engages against a shoulder 358 on the actuator cap 306 and which at its lower end is provided with a pair of prongs 359 that extend through apertures in the shoulder 350*a* of valve stem 350 into the chamber 351. A coil spring 360 is located between the shoulder 350*a* (on valve stem 350) and the undersurface of flange 357 (on collar 356) whereby this collar (and also the actuator cap 306) are biased upwardly away from the container 302.

FIG. 4*a* depicts the rest condition of the aerosol spray device 301 and it will be noted that the lower ends of prongs 359 locate at an upper region of chamber 351. It will also be noted the arms 354 are urged by the spring 355 to a position at which they pinch the flexible walled tube 353 closed.

When actuator cap 306 is depressed, the collar 356 moves downwardly against the bias of spring 358 causing the prongs 359 to move downwardly within chamber 351 to a position at which they move the arms 354 outwardly of the tube 353 which nevertheless maintain contact at their free ends with the coil spring 355. The configuration achieved is shown in FIG. 4*a* and it will be appreciated may now pass along the flexible walled tube 353 without significant pressure reduction, the fluid subsequently being discharged through the nozzle 308.

Once the actuator cap 306 is released, collar 356 is moved upwardly by spring 358 thus allowing spring 355 to return the arms 354 to the position shown in FIG. 4*a* at which the flexible wall tube 353 is closed to fluid flow.

Figure 5A:
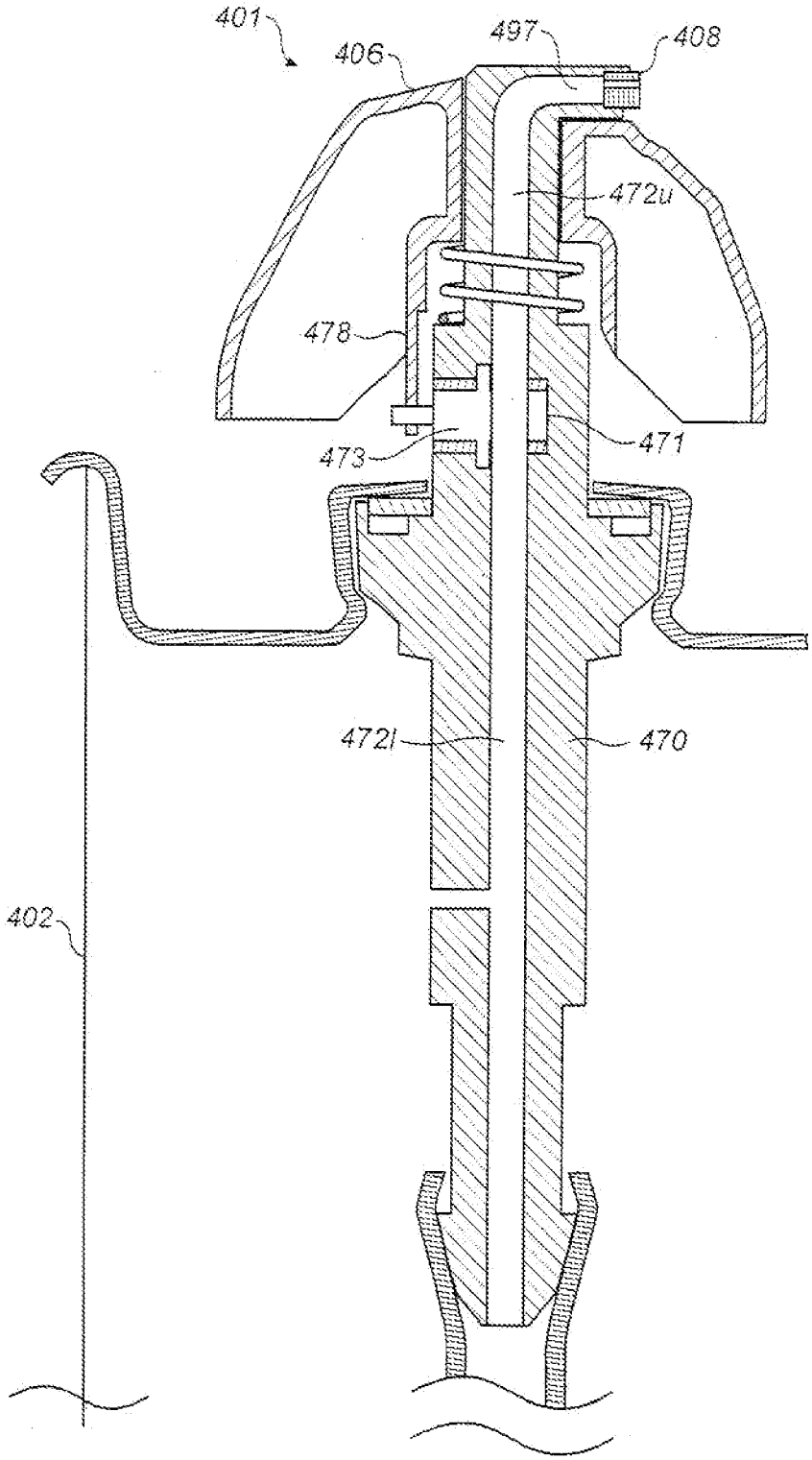
Figure 5B:
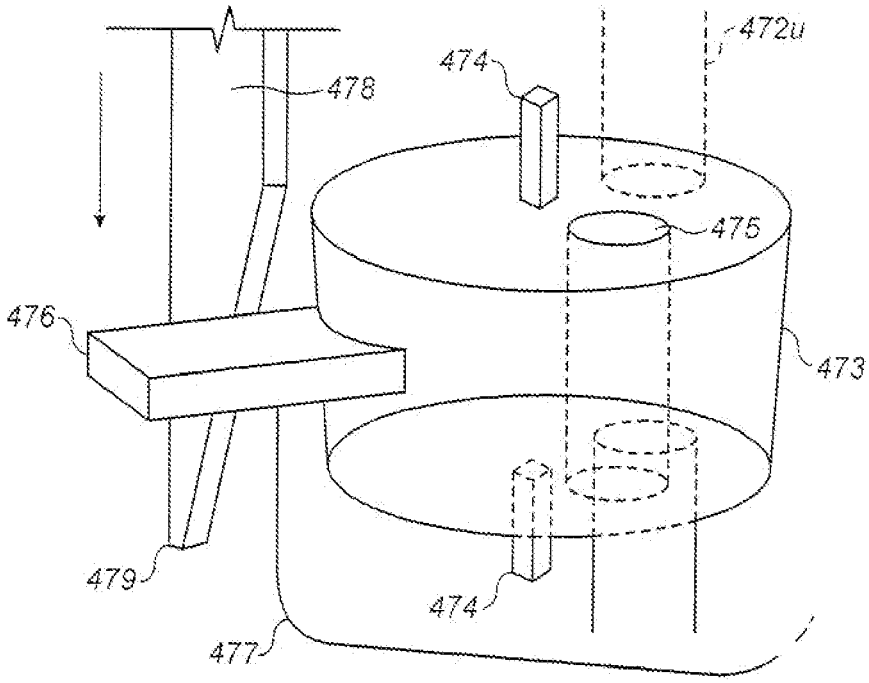

Reference is now made to FIGS. 5*a* and 5*b* which show a fifth embodiment of aerosol spray device 401 in accordance with the invention. For convenience, parts shown in FIGS. 5*a* and 5*b* which have a corresponding part in FIG. 1 are given the same reference numeral plus 400.

The aerosol spray device 401 of FIG. 5 has a one-piece valve stem 470 formed partway along its length with a chamber 471 above and below which the valve stem is formed with bore sections 472*u* and 472*l* respectively, these being of identical cross-section with each other.

Provided within chamber 471 is a cylindrical valve member 473 that is rotatably located within the chamber 471 by means of aligned pins 474 (see FIG. 5*b*) on the central axis of the cylinder. Cylindrical valve member 473 is formed with a passageway 475 which is parallel with the rotational axis but offset therefrom by a distance such that rotation of the cylindrical valve member 473 allows the passageway 475 to be brought into and out of register with bore sections 472*u* and 472*l* with which it is of identical cross-section.

Rotational movement of the cylindrical valve member 473 is effected by means of an actuator arm 476 which is affixed to the outer peripheral surface of valve member 473 and which projects from chamber 471.

In the rest condition of the aerosol spray device 401, the cylindrical valve member 473 is urged by a spring (depicted schematically by reference numeral 477) to a rotational position such that passageway 475 is out of register with bores sections 472*u* and 472*l*.

For the purposes of effecting spray discharge from the device 401, an arm 478 depends from (and is affixed to) the actuator cap 406 and is provided with a lower cam surface 479 (depicted as chamfered) which is capable (on depression of the actuator cap 406) of acting against actuator arm 476 so as to rotate the cylindrical valve member 473 (against the bias of spring 477) to a rotational position at which passageway 475 aligns with bore sections 472*u* and 472*l*. Thus fluid may now pass from the container 402 to the nozzle 406 without significant pressure loss.

FIG. 10*a* illustrates a sixth embodiment of a valve 501 which may be used in an aerosol spray device in accordance with the invention in the normal "rest" position. The valve 501 comprises a passageway 507 leading (at its downstream end) to a spray nozzle 508 (not shown), valve stem parts 509 and 510 and a ball 511, all assembled together in the manner described more fully below.

Depending from the upper valve stem part 509 is a tubular spigot 522 of a length such that, in the "rest" position of the aerosol device, the lower end of spigot 522 locates within a recessed cylindrical chamber 512. The spigot 522 is offset relative to the axis of the chamber 512. The ball 511 is made of metal (or polymer) and resides on a seat 513 at a first end of the chamber 512, thus creating a seal. The lower end of the spigot 522 has a chamfered edge 523. This is chamfered at an angle of 45°. The seat is surrounded by a conical chamfered surface 519 which facilitates the positioning of the ball against the seat 513.

The upper valve stem part 509 resides within a chamber 502 housed within the valve stem part 510. A coil spring 503 provided around spigot 522 and around the lower end of valve stem 509 serves to bias the latter to its upper position.

Valve stem 509 is located with its body within housing 510 and its head projecting beyond an annular seal 504 which is provided at the upper end of housing 510.

The valve stem part 509 is retained in the housing 510 by an annular flange 505.

The valve stem also includes an upstream valve stem part 506, to which valve stem housing 510 is sealably fitted by means of a screw fitting 514. The valve stem parts 509 and 506 are coaxial and have aligned bores 515*a* and 515*c* respectively. Bores 515*a* and 515*c* are of identical cross-section. Valve stem part 510 has a bore 515*b* whose axis is parallel to the axes of bores 515*a* and 515*c*, but is offset relative thereto.

Valve stem parts 510 and 506 are fixed relative to the container (not shown). Liquid is delivered to the bore 515*c* of valve stem part 506 via a dip tube 516 (not shown) affixed to the lower end 517 of valve stem part adaptor 506*a*. Additionally gas from headspace 5 can be bled into the bore 515*c* of valve stem part 506 via a passageway 518 located in the wall of lower valve stem part adaptor 506*a*, above the level to which container is initially filled. Whereas lower valve stem parts 506 and 510 are fixed, the upper valve stem part 509, on which an actuator cap (not shown) is mounted, is movable relative to the lower valve stem parts 510 and 506 and is biased away therefrom by a coil spring 503.

The valve stem parts 506 and 510 define a chamber 520 which contains a biasing wedge 521 and a displacing means 524. The biasing wedge returns the ball to the position shown in FIG. 10*a* when the spigot 522 moves out of registration with the opening 525 to the bore 515*c*. Displacing means 524 facilitates the lateral displacement of the ball 511 towards the wedge 521 when the spigot 522 is pushed towards the opening 525.

FIG. 10*b* shows the device of FIG. 10*a* when the actuator cap is depressed. Upper valve stem part 509 is caused to move downwardly so that the lower end of tubular spigot 522 moves towards opening 525. This pushes the ball 511 downwards and sideways by virtue of the displacement means 524, such that the ball 511 is pushed against wedge 521. Complete depression of the actuator causes the lower section of upper valve stem part 509 to come into registration with opening 525 of the bore 515*c*, so the latter is opened to liquid flow. Thus liquid in the container may now pass upwardly along the bore 515*c*, through the aligned bore 515*a* of the valve stem part 509 and through the passageway 507 (in actuator cap) to a nozzle insert (not shown) for discharge as a spray.

It will be appreciated that the device of FIGS. 10*a* and 10*b* provide no change in cross-sectional area as compared to the bores 515*a* and 515*c*. Thus the liquid 4 suffers substantially no pressure loss as it moves past the (now-open) ball 511 so that the pressure at the upstream end of the nozzle is effectively the same as the pressure within the container. This provides for much improved atomising efficiency within the nozzle, as compared to the case of a conventional valve where this is a significant pressure drop across the valve.

Once the actuator cap is released, valve stem part 509 is moved upwardly by the bias of coil spring 503 so that tubular spigot 522 moves away from opening 525. The ball 511 returns to its closed position at which it is maintained by the pressure within the container.

FIG. 11*a* shows a seventh embodiment of a valve 601 which is similar to that shown in FIGS. 10*a* and 10*b*. For convenience, component parts of the valve assembly 601 which are, in effect, equivalent to corresponding parts in the apparatus shown in FIG. 10*a* are identified by the same reference numeral incremented by 100, e.g. ball 611 as opposed to 511. In the interests of brevity, not all parts are labelled.

The valve 601 comprises a passageway 607 leading (at its downstream end) to a spray nozzle 608 (not shown), valve stem parts 609 and 610 and a ball 611.

The key difference compared to the device shown in FIGS. 10*a* and 10*b* is the presence of a biasing spring 621, located in an offset chamber 626. In FIG. 11*a*, the device is shown in the valve closed position ('rest') with the ball seated against the conical chamfered edge 619. The spring 621 is in contact with the ball 611 and biases it against the edge of the edge of the seat 613.

Depending from the upper valve stem part 609 is a tubular spigot 622 of a length such that, in the "rest" position of the aerosol device, the lower end of spigot 622 locates within a recessed cylindrical chamber 612. The spigot 622 is offset relative to the axis of the chamber 612. The ball 611 resides on a seat 613 at a first end of the chamber 612, thus creating a seal. The lower end of the spigot 622 has a chamfered edge 623. The seat is surrounded by a conical chamfered surface 619 which facilitates the positioning of the ball against the seat 613.

FIG. 11*b* shows the device of FIG. 11*a* when the actuator cap is depressed. Upper valve stem part 609 is caused to move downwardly so that the lower end of tubular spigot 622 moves towards opening 625. This pushes the ball 611 downwards and sideways by virtue of the displacement means 624, such that the ball 611 is pushed against spring 621. Complete depression of the actuator causes the lower section of upper valve stem part 609 to come into registration with opening 625 of the bore 615*c*, so the latter is opened to liquid flow. Thus liquid in the container may now pass upwardly along the bore 615*c*, through the aligned bore 615*a* of the valve stem part 609 and through the passageway 607 to a nozzle insert for discharge as a spray.

Once the actuator cap is released, valve stem part 609 is moved upwardly by the bias of coil spring 603 so that tubular spigot 622 moves away from opening 625. The ball 611 returns to its closed position at which it is maintained by the pressure within the container.

The valve of the present invention is particularly suited for spraying compositions which are more viscous than water alone. This is because (a) pressure losses are relatively higher through a "normal" aerosol valve for these more difficult products; and (b) it is very difficult to atomize these products to make a spray, so the pressure (thus energy) losses are critically important.

Thus, the valve of the present invention is particularly effective at spraying compositions which have a dynamic viscosity greater than $1\times10^{-3}$ Pa·s at about 25° C., preferably greater than $1\times10^{-2}$ Pa·s at about 25° C., preferably less than 50 Pa·s at about 25° C., preferably less than 10 Pa·s at about 25° C. For example, the present invention is particularly advantageous when it comes to spraying viscous liquids, suspensions, emulsions, thixotropic liquids and gels.

The apparatus of the present invention may be used as an aerosol spraying device, or a device for dispensing creams, gels or foams. Such a device may be used to deliver various materials, preferably materials dissolved or dispersed in water. For example, the liquid in the container may contain a range of materials selected from the group consisting of pharmaceutical, agrochemical, fragrance, air freshener, odour neutraliser, sanitizing agent, paint, oil (including cooking oil), sun-screen chemical, depilatory chemical (such as calcium thioglycolate), epilatory chemical, cosmetic agent, shaving cream, shaving gel, deodorant, anti-perspirant, anti-bacterial agents, anti-allergenic compounds, and mixtures of two or more thereof. Furthermore, the container may contain a foamable composition, optionally containing any of the materials disclosed immediately hereinbefore. The water in the container may optionally contain one or more organic solvents or dispersants in order to aid dissolution or dispersion of the materials in the water. Preferred solvents include ethanol and/or liquid butane.

The apparatus of the present invention may be used with an apparatus having a dispensing mechanism which turns on and off periodically. This may be automated.

For example, the apparatus of the present invention may be used to provide an air treatment agent to an air treatment device comprising: an airborne agent detector comprising one or more airborne agent sensors, wherein the airborne agent detector comprises means to detect a threshold level or concentration of an airborne agent; a means to mount the apparatus of the present invention (including the pressurised container where present) to the device; and a means to expel a portion of air treatment agent from the apparatus of the present invention, upon detection of an airborne agent by the detector. Such an air treatment device (not including the apparatus of the present invention) is disclosed in WO 2005/018690 for example. Alternatively, the apparatus of the present invention may be used to dispense a composition from a spraying device as disclosed in WO 2007/045826.

As used herein, the term "comprising" encompasses "including" as well as "consisting" e.g. a device "comprising" X may consist exclusively of X or may include something additional e.g. X+Y.

The term "about" in relation to a numerical value x means, for example, x±10%.

The word "substantially" does not exclude "completely". Where necessary, the word "substantially" may be omitted from the definition of the invention.

The invention is further illustrated with the following Examples.

EXAMPLE 1

A new low-loss cylindrical valve of the type shown in FIG. 2 and with conduit and exit each of 1 mm diameter was tested in accordance with the procedure of Appendix 1.

It was found that the valve had a loss coefficient (C) of 3.40.

COMPARATIVE EXAMPLE 2

Figure 6:
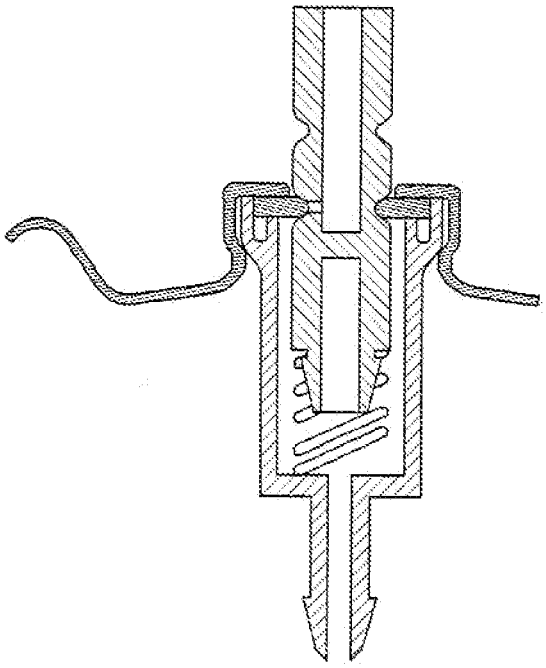
FIG. 6 illustrates a comparative valve of the type used with liquefied propellant hairspray aerosols.

This Comparative Example relates to the testing, using the procedure of Appendix 1, of a conventional aerosol valve illustrated in FIG. 6 which is of the type used with liquefied propellant hair spray aerosols. This had a single inlet for the stem with diameter 0.5 mm. The characteristic diameter was the internal diameter of the stem which had D=1.8 nm n.

Using the procedure of Appendix 1, the valve was found to have a loss coefficient (C) of 1750.

COMPARATIVE EXAMPLE 3

A conventional valve, of the type shown in FIG. 6 and described in Comparative Example 1, was modified by drilling 6 holes of 0.5 mm diameter as stem inlets, and also widening the channels through which the liquid must pass inside the valve.

Using the procedure described in Appendix 1, this modified conventional valve was found to have a loss coefficient (C) of 35.1.

APPENDIX 1

Figure 7:
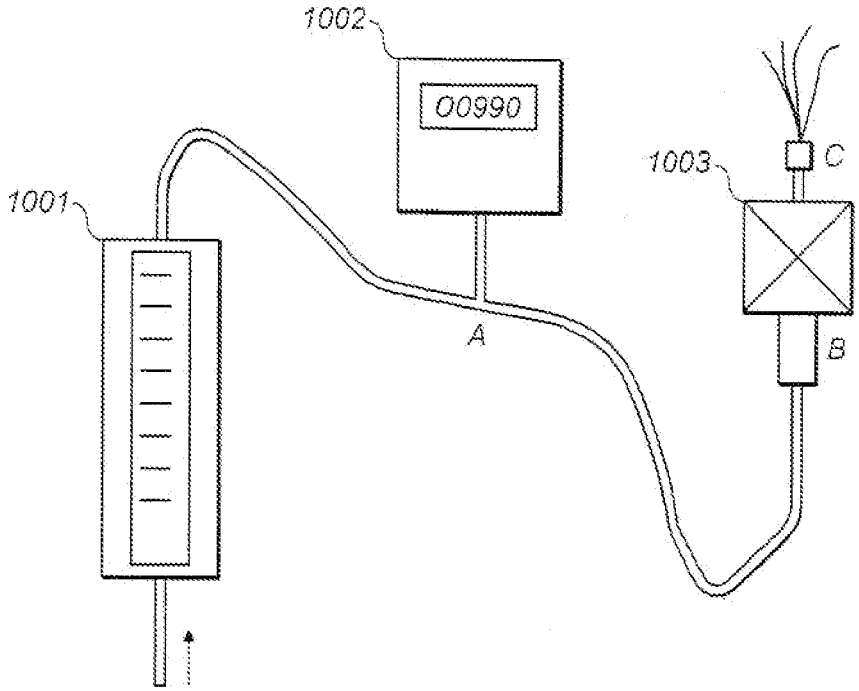
FIGS. 7-9 illustrate the testing procedure described in Appendix 1.
Figure 8:
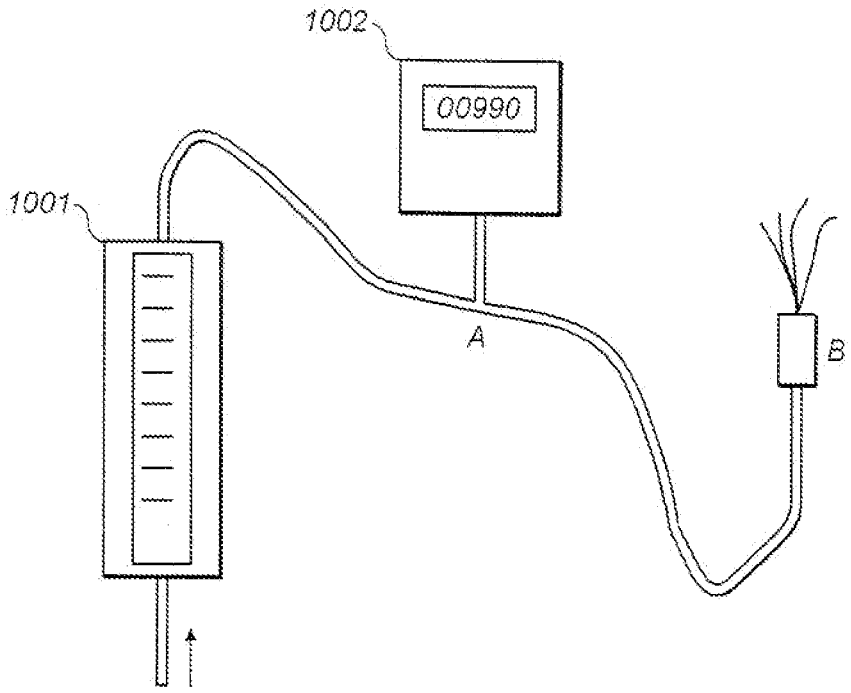

This Appendix describes the protocol for measuring pressure loss coefficient for a valve 1003 using a flow meter 1001 and a pressure measuring instrument 1002 (see FIGS. 7 and 8).

Referring to FIG. 7 the valve (1003) to be tested is mounted vertically with its, outlet C (at top). The inlet B (at bottom) is connected to 4 mm internal diameter flexible tubing using adaptor fittings if required. The length of tube linking the valve with the pressure measurement position A is 0.5 m It is essential that the pressure drop measured is representative of the valve itself and the pressure drop should not be influenced by additional loss creating components that may form part of an aerosol delivery device outlet or by the supply conduit to the valve. If such components, that do not form part of the valve, cannot be removed, their contribution to the pressure drop is taken into account by the procedure described below. The outlet and inlet of the valve should be representative of those for normal usage of the valve but should be modified if necessary such that they contain no restrictions or orifices. Thus any gas bleed inlets should be blocked without interfering with liquid flow in the conduit. Additionally, any restrictions to the flow along the conduit should be removed by clearing the restriction (e.g. by drilling) to leave a passage of the same cross-section as the diameter of the flow conduit. If the outlet of the valve, for example the internal chamber of the upper valve stem of a conventional valve, contains a restriction the stem should be drilled through or otherwise cleared to give a constant diameter for the outlet flow, with value equal to that of the section of chamber without the restriction. If it is necessary to remove the inlets and outlets to the valve then these should be replaced by replacement components with identical cross-sections and lengths to the originals. Thus, the internal cross-sections (e.g. diameters) of any replacement outlet and inlet should be representative of the values of the internal cross-sections (e.g. diameters) of those of the valve stem and valve feed conduit, from the dip tube, for normal usage of the valve.

The valve is supplied with distilled water, via the flow meter (1001), from a steady supply source at 20° C. The flow meter should be capable of providing measurements of water volume flow rate with 0.02 milliliter/sec accuracy, or better, and should cover at least the range from 0.2 milliters/sec to 2 milliliters/sec. A suitable flowmeter is a PLATON Varying Area Glass tube flow meter with a calibrated type A1SS-CA 07100 tube and float combination obtainable from Roxpur Measurement and Control Ltd of Sheffield.

At point A there is a junction at which a pressure measurement instrument (1002) is connected. This is preferably an electronic transducer type of device, designed for use with water, and should have an accuracy of 1.0 millibar (100 Pascals) or better with a range from zero up to at least 5 bar (5 kPa). A suitable instrument is a DRUCK DPI-705 Digital Pressure Indicator obtainable from DRUCK Ltd of Leicester. The outlet for the water at point C should be at the same height as point A.

In order to compare different valves, a common liquid volume flow rate Q=1.0 milliters/sec is used, this being representative of that found in the stem in many consumer aerosol devices. In order to calculate a characteristic flow velocity V for a valve at which the valve is to be tested, the internal diameters of the inlet B and outlet C should be measured. If these are not equal then the smaller value should be recorded.

Now, the representative cross-sectional area A is given by the expression:

$$A=\pi D^2/4$$

where D is the internal diameter of the inlet B and outlet C if the same or the lesser of the two if different.

Also, the characteristic test velocity V is represented by the equation:

$$Q=V\times A.$$

It can be shown that when D has the units mm and V has units m/s then a value of Q in milliliters/sec can be obtained from the expression:

$$Q=\pi D^2 V/4 \text{ milliliters/sec}$$

Given that the value of Q employed is 1.0 milliliters/sec, the value of V (flow velocity) to be used in the test can be calculated from the expression:

$$V=4/(\pi D^2)$$

As an example for a representative diameter D=1.0 mm, the characteristic flow velocity for the test would be 1.27 m/sec.

To carry out a test the valve is fully opened and the test flow rate is set up. When steady conditions have been established the pressure $P_1$ is recorded. It is important to ensure that there are no bubbles or airlocks in the flow path or in the valve. The test should be repeated at least 5 times and an average value of $P_1$ should be used.

Figure 9:
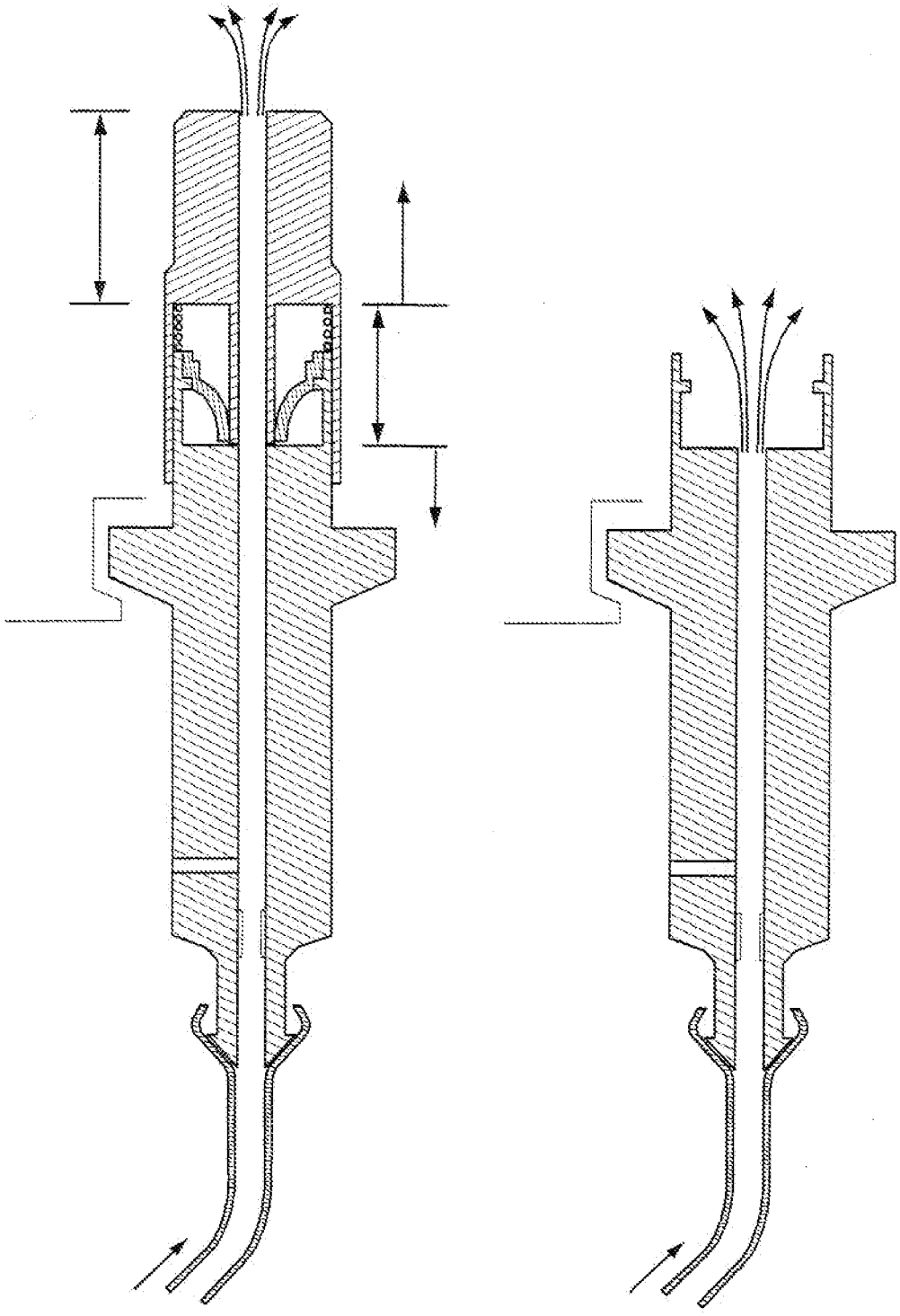

In order to remove the effects of pressure drops caused by other features of the flow between points A and C, that are not part of the valve, a second test should be carried out. As shown schematically in FIG. 8 the valve is removed however the supply conduit to the valve is retained. For a conventional aerosol valve, as shown in FIG. 6, the valve housing is kept in place and connected to the water supply, however the valve stem, spring, sealing gasket and metal aerosol cap (into which the valve housing is normally crimped) are removed. The procedure adopted in the case of the embodiment of the invention shown in FIG. 1 of the accompanying drawings is illustrated in FIG. 9.

A second test is carried out at the same flow rate as for the first test and a pressure $P_2$ is recorded.

The representative pressure drop for the valve is then found from $\Delta P=P_1-P_2$.

The loss coefficient C of the valve is found by dividing this pressure drop ΔP by the dynamic head of the flow at the valve, the dynamic head being ½ $\rho V^2$ where ρ is the density of the water, so:

$$C=\Delta P/(\tfrac{1}{2}\rho V^2) \text{ where } \Delta P \text{ has units Pascal, } \rho \text{ has units kg/m}^3\text{, and } V \text{ has units m/s.}$$

The invention claimed is:

1. A valving arrangement device for an aerosol spray device comprising a pressurized or pressurizable container, said valving arrangement provided between an upstream and downstream fluid flow path sections co-operable to provide a fluid flow path between liquid in the container and a nozzle, an actuator mechanism for selectively fully opening and closing the valving arrangement, wherein in its fully open configuration said valving arrangement is such that fluid passes from the upstream fluid flow path section into the downstream fluid flow path section with a change of the cross-sectional area of the fluid that is less than 50% and with a change in direction of the flow that is less than 40°;

wherein the upstream and downstream fluid flow path sections are moveable relatively towards each other with operation of the actuator mechanism to open the valving arrangement and wherein said valving arrangement is opened by said relative movement to allow said upstream and downstream flow path sections to come into register with each other.

2. The valve arrangement of claim 1, wherein the aerosol spray device comprises a pressurized container holding a liquid to be discharged by a propellant, upstream and downstream fluid flow path sections co-operable to provide a fluid flow path between liquid in the container and a nozzle, and an actuator mechanism for selectively fully opening and closing the valving arrangement.

3. A device according to claim 1, wherein the change of the cross-sectional area of the fluid is less than 25%.

4. A device according to claim 1, wherein the change of the cross-sectional area of the fluid is less than 10%.

5. A device according to claim 1, wherein there is no change in said cross-sectional area of the fluid flow.

6. A device according to claim 1, wherein any change in direction of the fluid flow is less than 20°.

7. A device according to claim 6, wherein there is no change in said direction of fluid flow.

8. A device according to claim 1, wherein the valving arrangement has a valve member with a bore of constant cross-section which is movable between a first position in which the valving arrangement is closed and a second position in which the bore aligns with said upstream and downstream fluid flow path section to provide for fully opening of the valving arrangement.

9. A device according to claim 1, wherein said valving arrangement comprises a ball.

10. A device according to claim 9, wherein said ball is biased against a seal in the first position.

11. A device according to claim 1, wherein the actuator is biased to a position at which the valving arrangement is closed.

12. A device according to claim 2, wherein the propellant is a compressed gas, the gas being one which remains as a gas at a temperature of 25° C. and a pressure at least 50 bar.

13. A device according to claim 2 having a passageway for introducing said gas from a headspace of the container into the upstream flow path section when the valving arrangement is open.

14. A device according to claim 12, wherein said gas is nitrogen, carbon dioxide or air.

15. A device according to claim 2, wherein the propellant is present as a gas phase and as a liquefied phase miscible with the liquid in the container.

16. A device according to claim 15, wherein the propellant is a hydrocarbon, preferably propane, butane or a mixture thereof.

17. A device according to claim 2, which contains a cream, gel, foam or foamable composition.

18. A device according to claim 2, wherein the liquid to be discharged includes a material selected from the group consisting of pharmaceutical, agrochemical, fragrance, air freshener, odor neutralizer, sanitizing agent, paint, oil (including cooking oil), sunscreen chemical, depilatory chemical (such as calcium thioglycolate), epilatory chemical, cosmetic agent, shaving cream, shaving gel, deodorant, anti-perspirant, antibacterial agents, anti-allergenic compounds, and mixtures of two or more thereof.

19. A device according to claim 2, wherein the liquid to be discharged includes a fragrance composition.

20. A device according to claim 2, wherein the liquid to be discharged includes an odor neutralizer composition.

21. A device according to claim 2, wherein the liquid to be discharged includes shaving foam.

22. A device according to claim 2, wherein the liquid to be discharged includes a depilatory composition.

23. A device according to claim 2, wherein the liquid to be discharged includes a paint composition.

24. A device according to claim 2, wherein the liquid to be discharged includes a sun-screen composition.

25. A device according to claim 2, wherein the liquid to be discharged includes an oil composition, preferably cooking oil.

26. A device according to claim 9, wherein the ball is movable by the valving arrangement from a first position fully obstructing the fluid flow path to fully close the valving arrangement to a second position fully displaced from the fluid flow path to fully open the valving arrangement.

27. A device according to claim 26 further comprising a displacing wedge for urging the ball towards the second position.

28. A device according to claim 26 further comprising a spring for biasing the ball into the first position.

29. A device according to claim 28, wherein the centerline of the spring is angled relative to the centerline of the fluid flow path.

30. A device according to claim 26 further comprising a biasing wedge for urging the ball towards the first position.

31. A device according to claim 26 further comprising a biasing wedge for urging the ball towards the first position and a displacing wedge for urging the ball towards the second position, the biasing wedge and the discharging wedge being positioned on opposite sides of the fluid flow path.

32. A device according to claim 2, which contains a material having a dynamic viscosity greater than $1\times10^{-3}$ Pa·s at about 25° C.

33. A device according to claim 2, which contains a material having a dynamic viscosity greater than $1\times10^{-2}$ Pa·s at about 25° C.

34. A device according to claim 2, which contains a material having a dynamic viscosity less than 50 Pa·s at about 25° C.

35. A device according to claim 2, which contains a material having a dynamic viscosity less than 10 Pa·s at about 25° C.

* * * * *